US008715109B2

(12) United States Patent
Bennett et al.

(10) Patent No.: US 8,715,109 B2
(45) **Date of Patent: *May 6, 2014**

(54) METAL WOOD CLUB WITH IMPROVED MOMENT OF INERTIA

(71) Applicant: Acushnet Company, Fairhaven, MA (US)

(72) Inventors: Thomas Orrin Bennett, Carlsbad, CA (US); Charles E. Golden, Encinitas, CA (US); Christopher D. Harvell, Escondido, CA (US); Stephen S. Murphy, Carlsbad, CA (US); Daniel Stone, Long Beach, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/850,992

(22) Filed: Mar. 26, 2013

(65) Prior Publication Data

US 2013/0252759 A1 Sep. 26, 2013

Related U.S. Application Data

(63) Continuation of application No. 13/085,711, filed on Apr. 13, 2011, now Pat. No. 8,419,569, which is a continuation of application No. 12/340,925, filed on Dec. 22, 2008, now Pat. No. 7,931,546, and a continuation-in-part of application No. 12/339,326, filed on Dec. 19, 2008, now Pat. No. 8,025,591, which is a continuation-in-part of application No. 12/193,110, filed on Aug. 18, 2008, now Pat. No. 7,758,454, which is a continuation-in-part of application No. 11/552,729, filed on Oct. 25, 2006, now Pat. No. 7,497,789, said application No. 12/193,110 is a continuation of application No. 11/552,729.

(51) Int. Cl.
*A63B 53/04* (2006.01)

(52) U.S. Cl.
USPC ..... 473/345; 473/349

(58) Field of Classification Search
USPC ..... 473/324–350
See application file for complete search history.

(56) References Cited

U.S. PATENT DOCUMENTS

| | | | |
|---|---|---|---|
| 4,420,156 | A | 12/1983 | Campau |
| 4,471,961 | A | 9/1984 | Masghati et al. |
| 5,094,457 | A | 3/1992 | Kinoshita |
| 5,429,357 | A | 7/1995 | Kobayashi |
| 5,681,228 | A | 10/1997 | Mikame et al. |
| 5,971,867 | A | 10/1999 | Galy |
| 6,017,280 | A | 1/2000 | Hubert |
| 6,033,319 | A | 3/2000 | Farrar |
| 6,077,172 | A | 6/2000 | Butler |

(Continued)

FOREIGN PATENT DOCUMENTS

| | | | |
|---|---|---|---|
| JP | 04347179 | A | 12/1992 |
| JP | 07155410 | A | 8/1995 |

(Continued)

*Primary Examiner* — Alvin Hunter
(74) *Attorney, Agent, or Firm* — Randy K. Chang

(57) ABSTRACT

A more efficient triangular shape for metal wood clubs or driver clubs is disclosed. This triangular shape allows the clubs to have higher rotational moments of inertia in both the vertical and horizontal directions, and a lower center of gravity.

18 Claims, 15 Drawing Sheets

(56) References Cited

U.S. PATENT DOCUMENTS

| | | | |
|---|---|---|---|
| 6,183,377 | B1 | 2/2001 | Liang |
| 6,217,461 | B1 | 4/2001 | Galy |
| 6,425,832 | B2 | 7/2002 | Cackett et al. |
| 6,491,592 | B2 | 12/2002 | Cackett et al. |
| 6,558,272 | B2 | 5/2003 | Helmstetter et al. |
| 6,607,452 | B2 | 8/2003 | Helmstetter et al. |
| 6,679,782 | B2 | 1/2004 | Tang et al. |
| 6,716,110 | B1 | 4/2004 | Ballow |
| 6,739,984 | B1 | 5/2004 | Ciasullo |
| 6,783,466 | B2 | 8/2004 | Seki et al. |
| 6,875,129 | B2 | 4/2005 | Erickson et al. |
| 6,878,073 | B2 | 4/2005 | Takeda |
| 6,880,222 | B2 | 4/2005 | Matsunaga |
| 6,955,612 | B2 | 10/2005 | Lu |
| 6,991,558 | B2 | 1/2006 | Beach et al. |
| 7,156,750 | B2 | 1/2007 | Nishitani et al. |
| 7,166,038 | B2 | 1/2007 | Williams et al. |
| 7,169,060 | B2 | 1/2007 | Stevens et al. |
| 7,182,699 | B2 | 2/2007 | Matsunaga |
| 7,198,575 | B2 | 4/2007 | Beach et al. |
| 7,204,768 | B2 | 4/2007 | Nakahara et al. |
| 7,258,626 | B2 | 8/2007 | Gibbs et al. |
| 7,347,796 | B2 | 3/2008 | Takeda |
| 7,410,428 | B1 | 8/2008 | Dawson et al. |
| 7,413,519 | B1 | 8/2008 | Dawson et al. |
| 7,413,520 | B1 | 8/2008 | Hocknell et al. |
| 7,419,442 | B1 | 9/2008 | Alan et al. |
| 7,431,666 | B2 | 10/2008 | Vincent et al. |
| 7,431,667 | B2 | 10/2008 | Vincent et al. |
| 7,497,789 | B2 | 3/2009 | Burnett et al. |
| 7,549,935 | B2 | 6/2009 | Foster et al. |
| 7,632,193 | B2 | 12/2009 | Thielen |
| 7,717,806 | B2 | 5/2010 | Kubota |
| 7,749,097 | B2 | 7/2010 | Foster et al. |
| 7,753,807 | B2 | 7/2010 | Nakano |
| 7,758,454 | B2 | 7/2010 | Burnett et al. |
| 8,025,591 | B2 | 9/2011 | De La Cruz et al. |
| 8,267,808 | B2 | 9/2012 | De La Cruz et al. |
| 8,419,569 | B2 * | 4/2013 | Bennett et al. ..... 473/345 |
| 2006/0148586 | A1 | 7/2006 | Williams et al. |

FOREIGN PATENT DOCUMENTS

| | | | |
|---|---|---|---|
| JP | 09051968 | A | 8/1995 |
| JP | 09215786 | A | 8/1997 |
| JP | 11114107 | A | 4/1999 |
| JP | 11114112 | A | 4/1999 |
| JP | 11178955 | A | 7/1999 |
| JP | 2000126339 | A | 5/2000 |
| JP | 2000176056 | A | 6/2000 |
| JP | 2000262656 | A | 9/2000 |
| JP | 2003062135 | A | 3/2003 |
| JP | 2003190340 | A | 7/2003 |
| JP | 2003265657 | A | 9/2003 |
| JP | 2004121395 | A | 4/2004 |
| JP | 2004261451 | A | 9/2004 |
| JP | 2005000576 | A | 1/2005 |
| JP | 2005177092 | A | 7/2005 |

* cited by examiner

METAL WOOD CLUB WITH IMPROVED MOMENT OF INERTIA

CROSS-REFERENCE TO RELATED APPLICATION

The present application is a continuation of co-pending U.S. patent application Ser. No. 13/085,711, filed on Apr. 13, 2011, which is a Continuation of U.S. patent application Ser. No. 12/340,925, filed Dec. 22, 2008, now U.S. Pat. No. 7,931,546, which is a Continuation-In-Part of U.S. application Ser. No. 12/193,110, now U.S. Pat. No. 7,758,454, filed Aug. 18, 2008, which is a continuation of U.S. patent application Ser. No. 11/552,729, now U.S. Pat. No. 7,497,789, filed Oct. 25, 2006, the disclosure of which are all incorporated herein by reference in its entirety. In addition to the above, U.S. patent application Ser. No. 12/340,925 is also a Continuation-In-Part of pending U.S. application Ser. No. 12/339,326, filed Dec. 19, 2008, which is a Continuation-In-Part of U.S. application Ser. No. 11/522,729, now U.S. Pat. No. 7,497,789, filed on Oct. 25, 2006, the disclosure of which are also all incorporated herein by reference in its entirety.

FIELD OF THE INVENTION

The present invention relates to an improved metal wood or driver golf club. More particularly, the present invention relates to a hollow golf club head with a lower center of gravity and a higher moment of inertia.

BACKGROUND OF THE INVENTION

The complexities of golf club design are known. The specifications for each component of the club (i.e., the club head, shaft, grip, and subcomponents thereof) directly impact the performance of the club. Thus, by varying the design specifications a golf club can be tailored to have specific performance characteristics.

The design of club heads has long been studied. Among the more prominent considerations in club head design are loft, lie, face angle, horizontal face bulge, vertical face roll, center of gravity, rotational moment of inertia, material selection, and overall head weight. While this basic set of criteria is generally the focus of golf club designers, several other design aspects must also be addressed. The interior design of the club head may be tailored to achieve particular characteristics, such as the inclusion of a hosel or a shaft attachment means, perimeter weights on the club head, and fillers within the hollow club heads.

Golf club heads must also be strong to withstand the repeated impacts that occur during collisions between the golf club and the golf balls. The loading that occurs during this transient event can create a peak force of over 2,000 lbs. Thus, a major challenge is to design the club face and club body to resist permanent deformation or failure by material yield or fracture. Conventional hollow metal wood drivers made from titanium typically have a uniform face thickness exceeding 2.5 mm or 0.10 inch to ensure structural integrity of the club head.

Players generally seek a metal wood driver and golf ball combination that delivers maximum distance and landing accuracy. The distance a ball travels after impact is dictated by the magnitude and direction of the ball's initial velocity and the ball's rotational velocity or spin. Environmental conditions, including atmospheric pressure, humidity, temperature, and wind speed, further influence the ball's flight. However, these environmental effects are beyond the control of the golf equipment designers. Golf ball landing accuracy is driven by a number of factors as well. Some of these factors are attributed to club head design, such as center of gravity and club face flexibility.

Concerned that improvements to golf equipment may render the game less challenging, the United States Golf Association (USGA), the governing body for the rules of golf in the United States, has specifications for the performance of golf equipment. These performance specifications dictate the size and weight of a conforming golf ball or a conforming golf club. USGA rules limit a number of parameters for drivers. For example, the volume of drivers has been limited to 460±10 cubic centimeters. The length of the shaft, except for putter, has been capped at 48 inches. The driver clubs have to fit inside a 5-inch square and the height from the sole to the crown cannot exceed 2.8 inches. The USGA has further limited the coefficient of restitution of the impact between a driver and a golf ball to 0.830.

The USGA has also observed that the rotational moment of inertia of drivers, or the club's resistance to twisting on off-center hits, has tripled from about 1990 to 2005, which coincides with the introduction of oversize drivers. Since drivers with higher rotational moment of inertia are more forgiving on off-center hits, the USGA was concerned that further increases in the club head's inertia may reduce the challenge of the game, albeit that only mid and high handicap players would benefit from drivers with high moment of inertia due to their tendencies for off-center hits. In 2006, the USGA promulgated a limit on the moment of inertia for drivers at 5900 $g\cdot cm^2 \pm 100\ g\cdot cm^2$ or $32.259\ oz\cdot in^2 \pm 0.547\ oz\cdot in^2$. The limit on the moment of inertia is to be measured around a vertical axis, the y-axis as used herein, through the center of gravity of the club head.

A number of patent references have disclosed driver clubs with high moment of inertia, such as U.S. Pat. Nos. 6,607,452 and 6,425,832. These driver clubs use a circular weight strip disposed around the perimeter of the club body away from the hitting face to obtain a moment of inertia from 2800 to 5000 $g\cdot cm^2$ about the vertical axis. U.S. Pat. App. Pub. No. 2006/0148586 A1 discloses driver clubs with moment of inertia in the vertical direction from 3500 to 6000 $g\cdot cm^2$. However, the '586 application limits the shape of the driver club to be substantially square when viewed from the top, and the moment of inertia in the horizontal direction through the center of gravity is significantly lower than the moment of inertia in the vertical direction.

However, most oversize drivers on the market at this time have moments of inertia in the range of about 4,000 to 4,300 $g\cdot cm^2$. Hence, there remains a need for more forgiving drivers or metal wood clubs for mid to high handicap players to take advantage of the higher limit on moment of inertia in both the vertical and horizontal directions. Moreover, the current art lacks a suitable drive or metal wood club that has a large moment of inertia around the vertical axis $I_{yy}$ or a large moment of inertia around the horizontal axis $I_{xx}$ both through the center of gravity when compared to the volume of the club head.

BRIEF SUMMARY OF THE INVENTION

The present invention includes more efficient shapes for hollow club heads, such as metal woods, drivers, fairway woods, putters or utility clubs in addition to traditional shapes. These shapes include, but are not limited to, triangles, truncated triangles, pear shaped, elliptical shaped, symmetrical shaped, or trapezoids. These shapes use less surface area, and more weight can be re-positioned to improve the rotational moments of inertia and the location of the center of gravity.

The present invention also includes hollow golf club heads that have a lightweight midsection so that more weight can be redistributed to improve the rotational moments of inertia and the location of the center of gravity.

BRIEF DESCRIPTION OF DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

Figure 1:
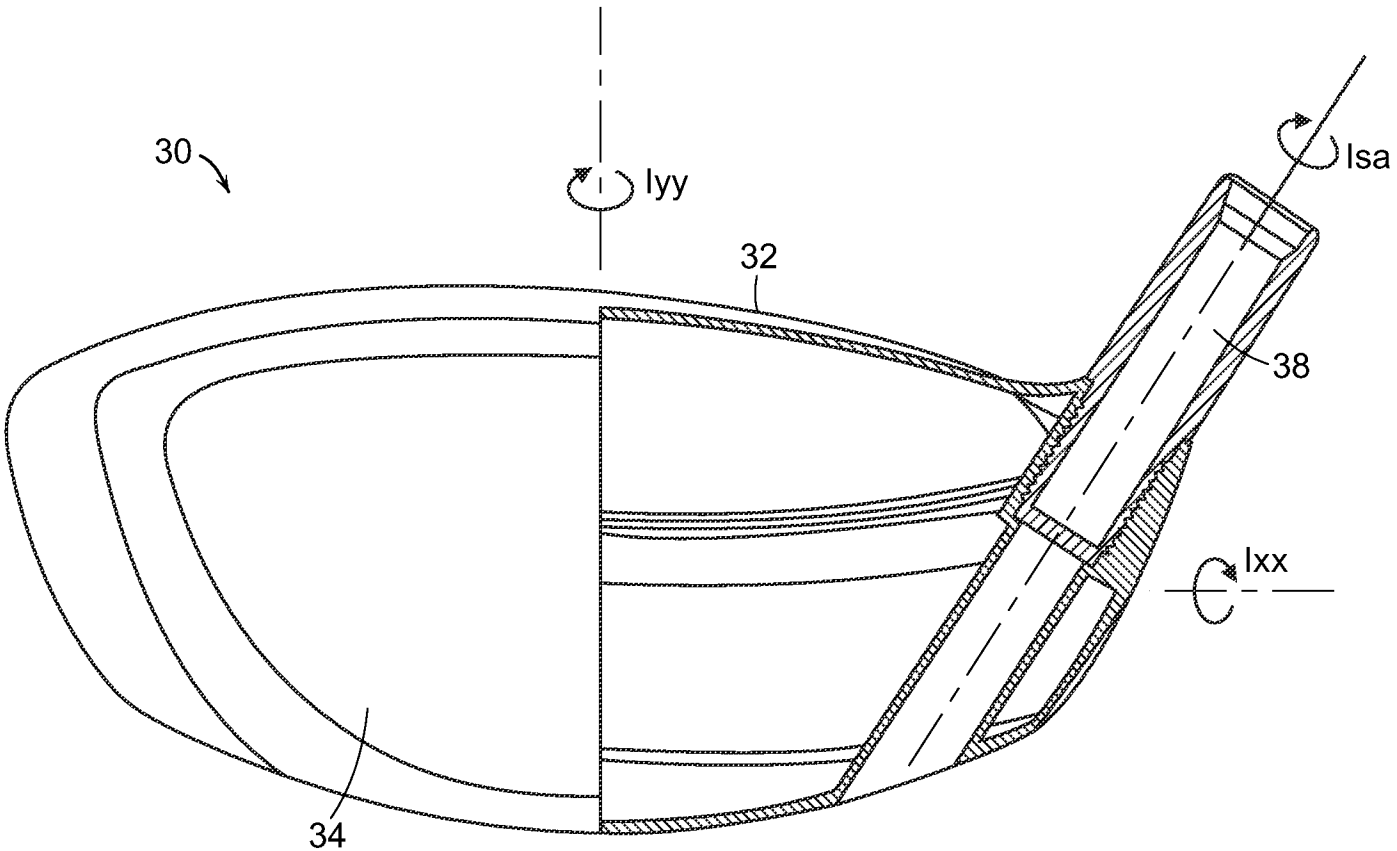
FIG. 1 is a front, partial cut-away view of an inventive club head to show the interior of the club head.

Rotational moment of inertia ("MOI" or "Inertia") in golf clubs is well known in the art, and is fully discussed in many references, including U.S. Pat. No. 4,420,156, which is incorporated herein by reference in its entirety. When the inertia is too low, the club head tends to rotate excessively from off-center hits. Higher inertia indicates higher rotational mass and less rotation from off-center hits, thereby allowing off-center hits to fly farther and closer to the intended path. Inertia can be measured about a vertical axis going through the center of gravity of the club head ($I_{yy}$), and about a horizontal axis through the center of gravity (c.g.) of the club head ($I_{xx}$), as shown in FIG. 1. The tendency of the club head to rotate around the vertical y-axis through the c.g. indicates the amount of rotation that an off-center hit away from the y-axis causes. Similarly, the tendency of the club head to rotate around the horizontal x-axis through the c.g. indicates the amount of rotation that an off-center hit away from the x-axis through the c.g. causes. Most off-center hits cause a tendency to rotate around both x and y axes. High $I_{xx}$ and $I_{yy}$ reduce the tendency to rotate and provide more forgiveness to off-center hits.

Inertia is also measured about the shaft axis ($I_{sa}$), also shown in FIG. 1. First, the face of the club is set in the address position, then the face is squared and the loft angle and the lie angle are set before measurements are taken. Any golf ball hit has a tendency to cause the club head to rotate around the shaft axis. An off-center hit toward the toe would produce the highest tendency to rotate about the shaft axis, and an off-center hit toward the heel causes the lowest. High $I_{sa}$ reduces the tendency to rotate and provides more control of the hitting face.

In general, to increase the sweet spot, the center of gravity of the club head is moved toward the bottom and back of the club head. This permits an average golfer to launch the ball up in the air faster and hit the ball farther. In addition, the moment of inertia of the club head is increased to minimize the distance and accuracy penalties associated with off-center hits. In order to move the weight down and back without increasing the overall weight of the club head, material or mass is taken from one area of the club head and moved to another. Materials can be taken from the face of the club, creating a thin club face, the crown and/or the sole and placed toward the back of the club.

Figure 2B:
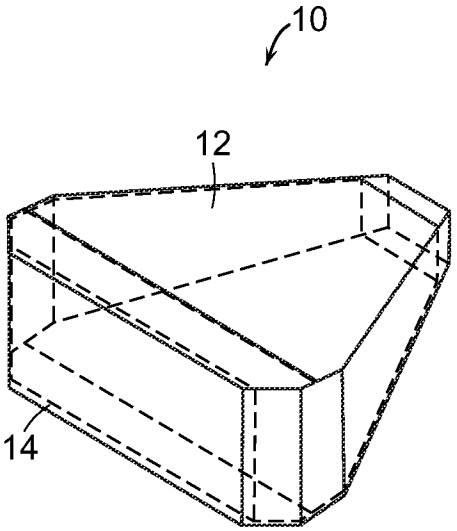
FIGS. 2*a*-2*d* are the top, perspective, side and front views, respectively, of an idealized triangular inventive club head.
Figure 2C:
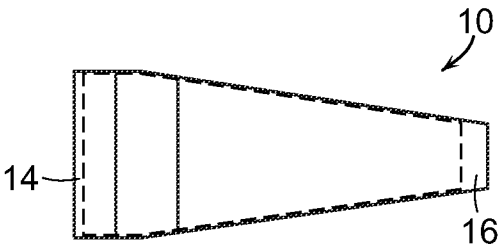
Figure 2A:
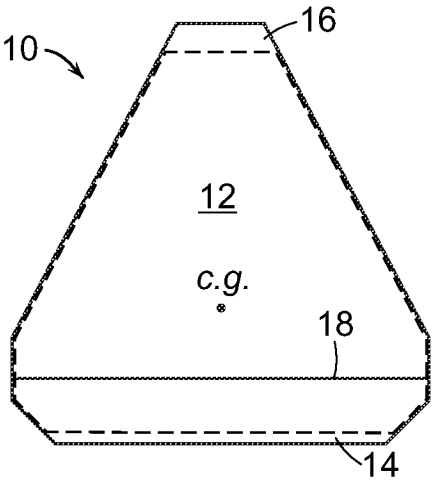
Figure 2D:
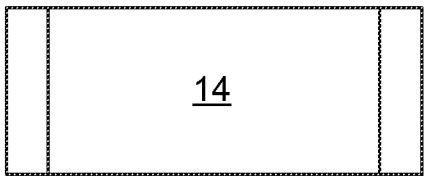

The inventors of the present invention have discovered a unique and efficient shape for a club head that can provide high rotational moments of inertia in both the vertical and horizontal axis through the c.g. Such a club head is illustrated in an idealized form in FIGS. 2*a*-2*d*. Idealized club head 10 when viewed from the top has a truncated triangular or trapezoidal crown 12, as shown in FIG. 2*a*, and its skirt/side is tapered from hitting face 14 to aft 16, as shown in FIG. 2*c*. As used herein, the term "triangular" or "triangular shaped" means substantially a trapezoidal shape or a truncated triangular shape with or without the corners being rounded off.

Idealized club head 10 meets all of the USGA size limits. More particularly, the volume of the club head is set at 460 cc and its weight is limited to 200 grams. As best shown in FIG. 2*a*, the distance from hitting face 14 to aft 16 is 5 inches and the widest part of club head 10, labeled as line 18, is also 5 inches wide. Therefore, club head 10 fits within the USGA's 5-inch square. Hitting face 14 is 2 inches high, which is below the USGA's 2.8 inch limit, and is 4 inches long. Aft 16 is slightly more than 0.75 inches high and slightly more than 1 inch long. The horizontal length of aft 16 is about ⅛ to about ⅓ of the length of hitting face 14 and more preferably about ¼. These dimensions are selected so that the idealized club head meets the volume limit set by the USGA.

The thickness of hitting face 14 is set at 0.122 inch to imitate an actual hitting face and the side wall of the rest of the club is set at about 0.026 inch. While keeping the weight of the club head at 200 grams, due to the efficient use of surface area, i.e., minimizing the surface area of the club head to reduce the weight of the club head, a weight of about 19 grams can be saved and can be positioned proximate to aft 16 to maximize the location of the c.g. and to maximize the rotational inertias of the club head. The mass properties of idealized club head 10 are shown in Table 1.

TABLE 1

| | Triangular Idealized Club Head 10 |
|---|---|
| Volume | 460 cc |
| Weight | 200 grams |
| C.G. relative to geometric center of face 14 | x = 0.0 inch<br>y = −0.038 inch<br>z = −1.611 inches |

TABLE 1-continued

| | Triangular Idealized Club Head 10 |
|---|---|
| $I_{xx}$ | 4325 g · cm$^2$ |
| $I_{yy}$ | 5920 g · cm$^2$ |
| Additional weight at aft 16 | 19 grams |

As shown in Table 1, $I_{yy}$ or the vertical rotational inertia through c.g. is at the USGA limit and $I_{xx}$ or the horizontal rotational inertia through c.g. is also substantial. A relatively high $I_{xx}$ is more forgiving on high or low impacts with the golf balls relative to the c.g. and reduces the tendency to alter the trajectory of the ball's flight. The inertias shown in Tables 1, 2 and 3 are calculated using a commercially available CAD (computer aided design) system.

Figure 3B:
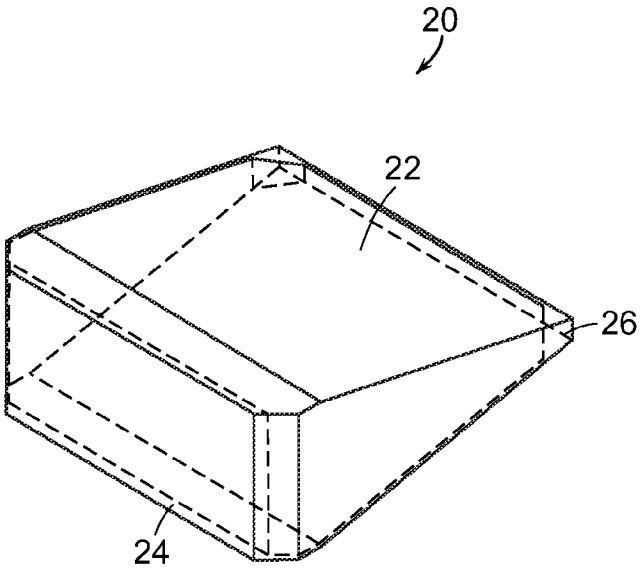
FIGS. 3*a*-3*d* are the top, perspective, side and front views, respectively, of another idealized club head.
Figure 3C:
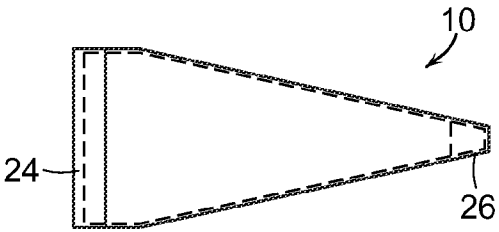
Figure 3A:
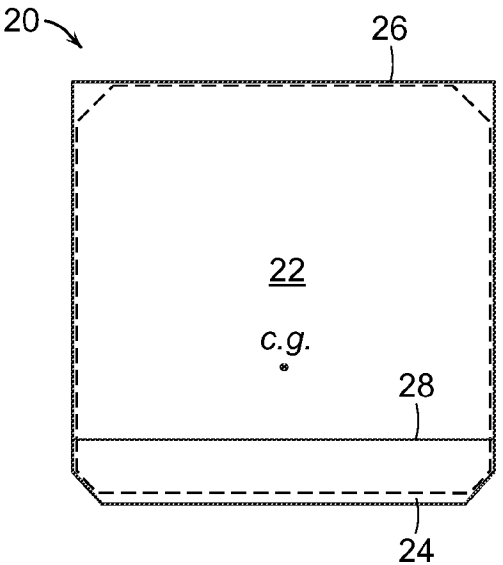
Figure 3D:
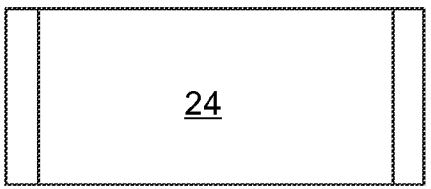

Another idealized club head shape, shown in FIGS. 3*a*-3*c*, was analyzed. Idealized club head 20 has the same volume and weight as idealized club head 10. Club head 20 has a substantially square crown 22 when viewed from the top, shown in FIG. 3*a*, and tapered skirt/side when viewed from the side, shown in FIG. 3*c*. As best shown in FIG. 3*a*, the distance from hitting face 24 to aft 26 is 4.72 inches and the widest part of club head 20, labeled as line 28, is also 4.72 inches wide. Therefore, club head 10 fits within the USGA's 5-inch square. Hitting face 24 is also 2 inches high, which is below the USGA's 2.8 inch limit, and is also 4 inches long. Aft 26 is slightly more than 0.25 inches high and also 4.72 inches long to maintain the rectangular shape. These dimensions are selected so that idealized club head 20 meets the volume limit set by the USGA.

The thickness of hitting face 24 is also set at 0.122 inch to imitate an actual hitting face and the side wall of the rest of the club is set at about 0.026 inch. While keeping the weight of the club head at 200 grams, due to the higher surface area caused by the rectangular shape, a weight of only 3.7 grams can be saved and positioned proximate to aft 26. The mass properties of idealized club head 20 are shown and compared to those of idealized club head 10 in Table 2.

TABLE 2

| | Triangular Idealized Club Head 10 | Square Idealized Club Head 20 |
|---|---|---|
| Volume | 460 cc | 460 cc |
| Weight | 200 grams | 200 grams |
| C.G. relative to geometric center of hitting face | x = 0.0 inch<br>y = −0.038 inch<br>z = −1.611 inches | x = 0.0 inch<br>y = −0.038 inch<br>z = −1.539 inches |
| $I_{xx}$ | 4325 g · cm$^2$ | 3672 g · cm$^2$ |
| $I_{yy}$ | 5920 g · cm$^2$ | 5960 g · cm$^2$ |
| $I_{xx}/I_{yy}$ | 0.73 | 0.62 |
| Additional weight at aft portion | 19 grams | 3.7 grams |

The advantages of the triangular shape for the driver club head are clearly shown in Table 2. While the weight, volume and $I_{yy}$ are the same or substantially the same for both shapes, the more efficient triangular shape allows significantly more weight to be placed aft of the hitting face to improve c.g. and $I_{xx}$.

Figure 4:
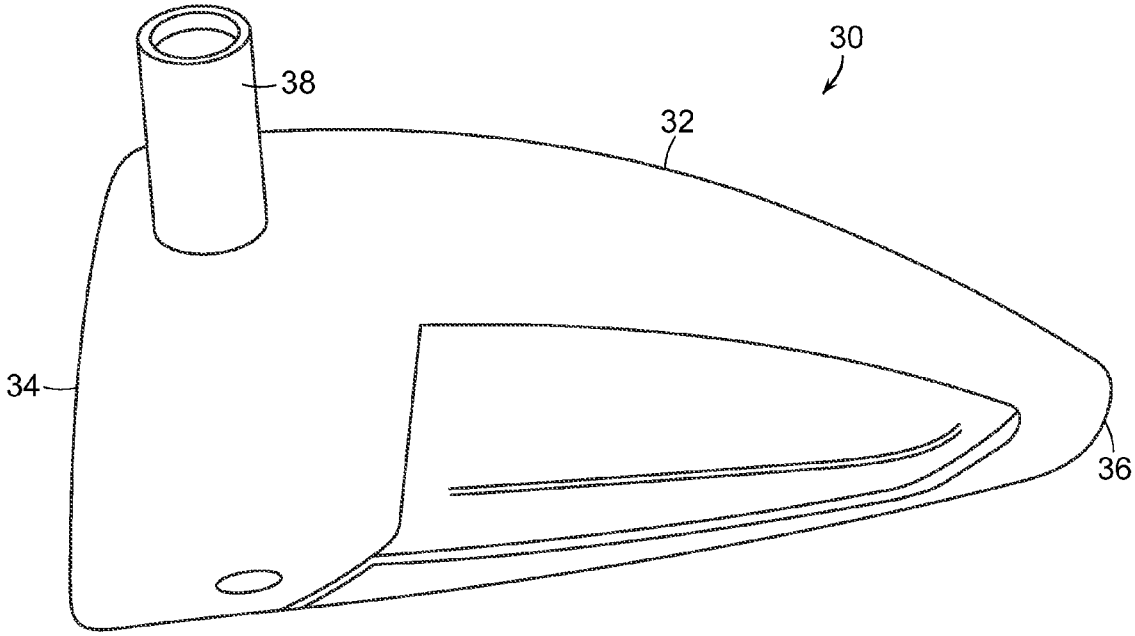
FIG. 4 is a side view of the club head of FIG. 1.
Figure 5:
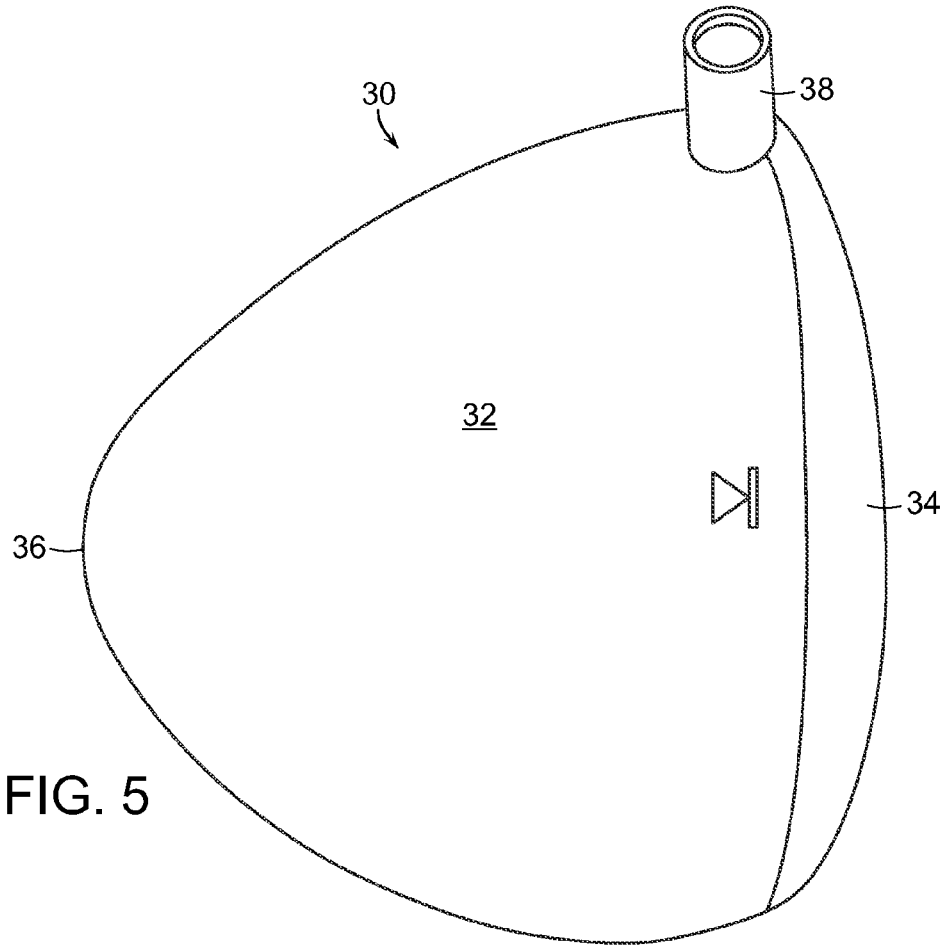
FIG. 5 is a top view of the club head of FIG. 1.

Club head 30, as shown in FIGS. 1, 4 and 5, incorporates the advantages of idealized triangular shaped club head 10. Club head 30 has crown 32, hitting face 34, aft or rear 36 and hosel 38. As best shown in FIG. 5, crown 32 has a substantially triangular or trapezoidal shape from hitting face 34 to aft 36, with hitting face 34 forming the base of the triangle or trapezoid and aft 36 forming a rounded apex of the triangle or a short top base of the trapezoid. Preferably, aft 36 has a horizontal length of about 12.5% to about 33% and preferably about 25% of the horizontal length of hitting face 34. As best shown in FIG. 4, club head 30 has a tapered skirt/side going from the hitting face on the heel side and on the toe side toward the rear of the club, similar to idealized club head 10. The skirt/side of club head 30 preferably includes at least one section that is substantially straight.

The volume of club head 30 is about 450 cc or higher and its weight is about 194 grams to about 200 grams. Its height is about 2.4 inches or less. The entire club head can fit into a 5-inch square with about 5 mm of clearance. Hosel 38 is preferably made from a low density material, such as aluminum, and is located substantially above a plane located at a peak of crown 32. This triangular/trapezoidal shape has less than about 8% by volume behind the c.g. than a traditional pear shaped driver. The club has a titanium hitting face with a thickness of about 0.130 inch. The rest of the club is made from titanium with a thickness of about 0.024 inch for the crown and skirt and about 0.030 inch for the sole. The mass properties of inventive, non-idealized club head 30 are shown in TABLE 3.

TABLE 3

| | Triangular Club Head 30 |
|---|---|
| Volume | 450 cc or higher |
| Weight | 197 grams |
| C.G. relative to geometric center of face 34 | x = 0.120 inch<br>y = −0.022 inch |
| C.G relative to the shaft axis | z = −0.732 inch |
| C.G. relative to ground at address position | y = 1.085 inches |
| $I_{xx}$ | 3350 g · cm$^2$ |
| $I_{yy}$ | 5080 g · cm$^2$ |
| Additional weight at aft 36 | 16 grams |

In accordance with another aspect of the present invention, weight from the crown, sole and skirt/side of the club head is moved aft or to the perimeter of the club head to increase rotational inertia of the club head. Additionally, a mid-section of the club head is made from a lightweight material, such as carbon fiber composites, aluminum, magnesium, thermoplastic or thermoset polymers, so that additional weights can be re-deployed from the midsection to the aft section and/or along the perimeter.

Figure 6:
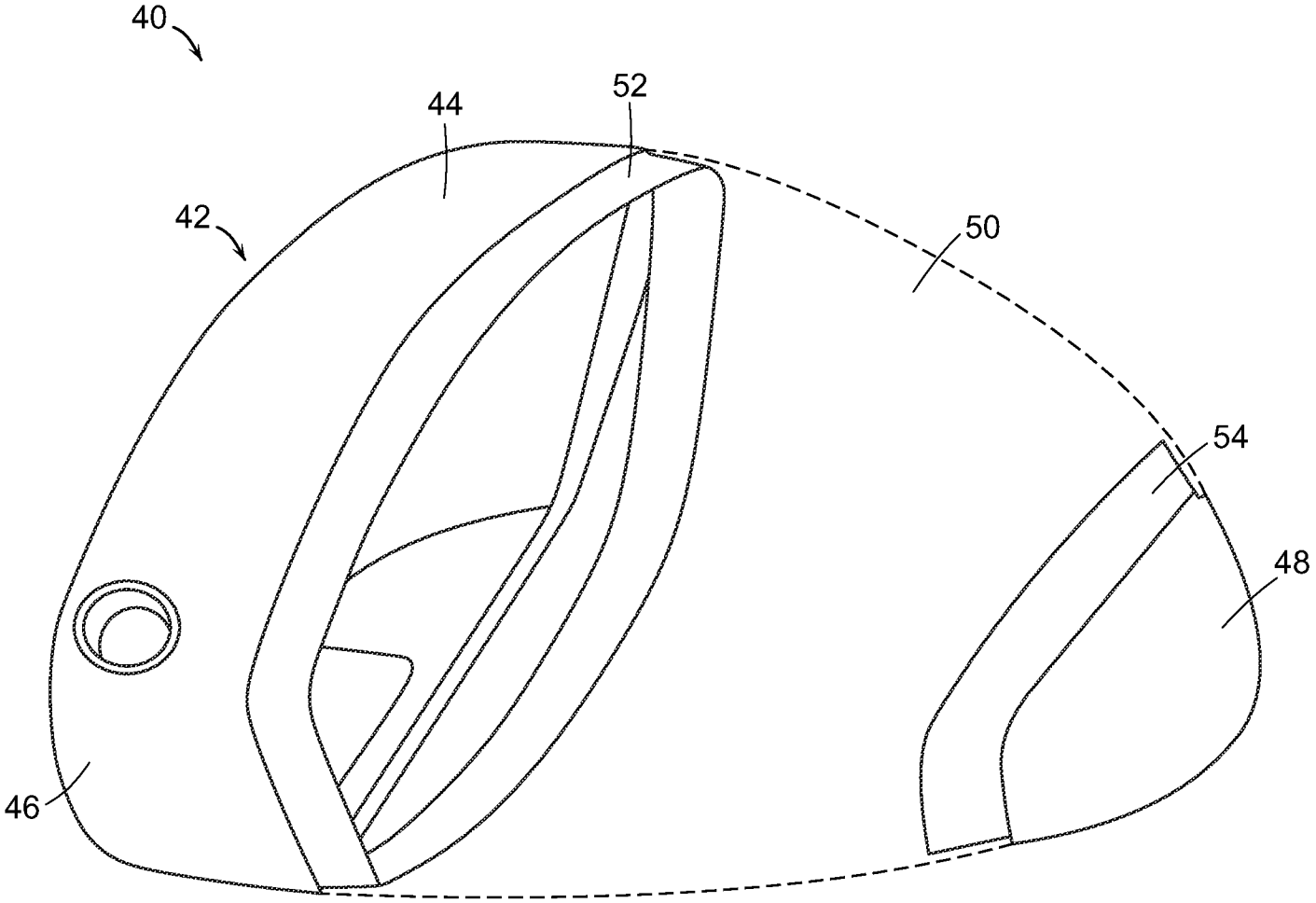
FIG. 6 is a side perspective view of another embodiment of FIG. 1, wherein the club head comprises a lightweight midsection.

As shown in FIG. 6, club head 40, which has substantially the same shape as club head 30, comprises front hitting cup 42, which includes hitting face (not shown), crown portion 44, heel skirt portion 46, toe portion (not shown) and heel portion (not shown). Club head 40 also has aft cup 48, which is spaced apart from front hitting cup 42. Aft cup 48 and front hitting cup 42 are preferably made by casting or forging with titanium or stainless steel or both. Midsection 50, shown in broken lines, is attached to front hitting cup 42 at front ledge 52 and attached to aft cup 48 at back ledge 54. In one preferred embodiment, midsection 50 is made from a lightweight carbon fiber reinforced tube. The surfaces of ledges 52 and 54 are preferably recessed from the surfaces of front hitting cup 42 and aft cup 48, so that when midsection 50 is attached to front hitting cup 42 and to aft cup 48, the surface of club head 40 possesses a single smooth surface. Ledge 52 and 54 can be made from the same materials as front hitting cup 42 and aft cup 48 and integral therewith, or they can also be made from another lightweight material.

In one embodiment, midsection 50 is attached to front hitting cup 42 and aft cup 48 by adhesives, such as DP420NS or DP460NS, which are two-part epoxies available from 3M, among other known adhesives.

In Table 4 below, the mass properties calculated by a CAD program of an all titanium version of club head 30 and of composite club head 40 are shown. In this example, club head 40 is made out of titanium, which has a density of about 4.43 g/cc, and has carbon fiber tube midsection, which has a density of about 1.2 g/cc. The density of the midsection should be equal to or less than about half as much as and preferably equal to or less than about a third as much as the density of front hitting cup and/or the density of the aft cup.

TABLE 4

| | All Titanium Club Head 30 | Club Head 40 with Titanium and Carbon Fiber Tube | Club Head 140 |
|---|---|---|---|
| Volume | 464 cc | 464 cc | 449 cc |
| Weight | 197 grams | 197 grams | 197 grams |
| Wall thickness, except at hitting face | 0.024 inch | 0.030 inch at Ti walls and 0.035 inch at midsection | 0.030 inch at Ti walls and 0.035 inch at midsection |
| C.G. relative to geometric center of hitting face | x = 0.076 inch<br>y = −0.029 inch | x = 0.147 inch<br>y = −0.064 inch | x = 0.020 inch<br>y = 0.024 inch |
| C.G. relative to the shaft axis | z = −0.807 inch | z = −1.017 inches | z = −0.721 inch |
| C.G. relative to ground at address position | y = 1.080 inches | y = 1.045 inches | y = 1.122 inches |
| $I_{xx}$ | 3500 g · cm$^2$ | 4400 g · cm$^2$ | 2969 g · cm$^2$ |
| $I_{yy}$ | 5210 g · cm$^2$ | 5830 g · cm$^2$ | 4748 g · cm$^2$ |
| Additional weight at aft portion | 21 grams | 43.3 grams | 38 grams |

The results from Table 4 show that using the lightweight midsection allows 43.3 grams of weight (instead of 21 grams) to be utilized aft or around the perimeter to increase rotational inertias. The c.g. is lowered by about 0.035 inch. $I_{yy}$ is increased by about 11.9% and $I_{xx}$ is increased by about 25.7%.

Figure 7:
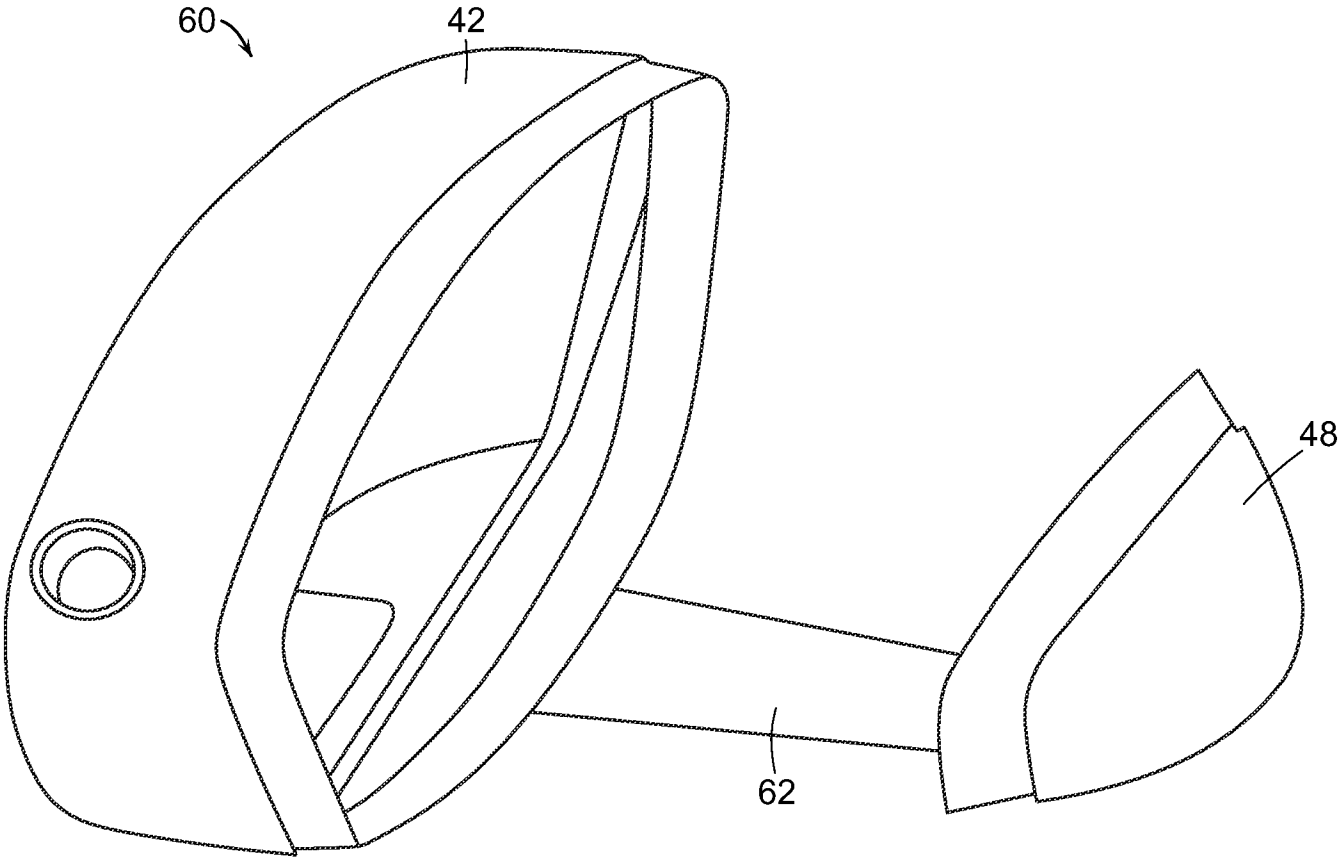
FIGS. 7-13 are perspective views of other embodiments of inventive club heads with lightweight midsections.

Other embodiments of the triangular/trapezoidal club head with lightweight midsections are shown in FIGS. 7-13. Club head 60, shown in FIG. 7, is similar to club head 40, except that front hitting cup 42 is connected to aft cup 48 with a single bridge, i.e., sole bridge 62, made from the same material as the front hitting cup and/or the aft cup to increase structural support. This single bridge can be located anywhere on the club head, e.g., at the heel, crown, toe or any corners on the club head. Lightweight midsection 50 can be attached to front ledge 52, back ledge 54 and to the bridge(s).

Figure 8:
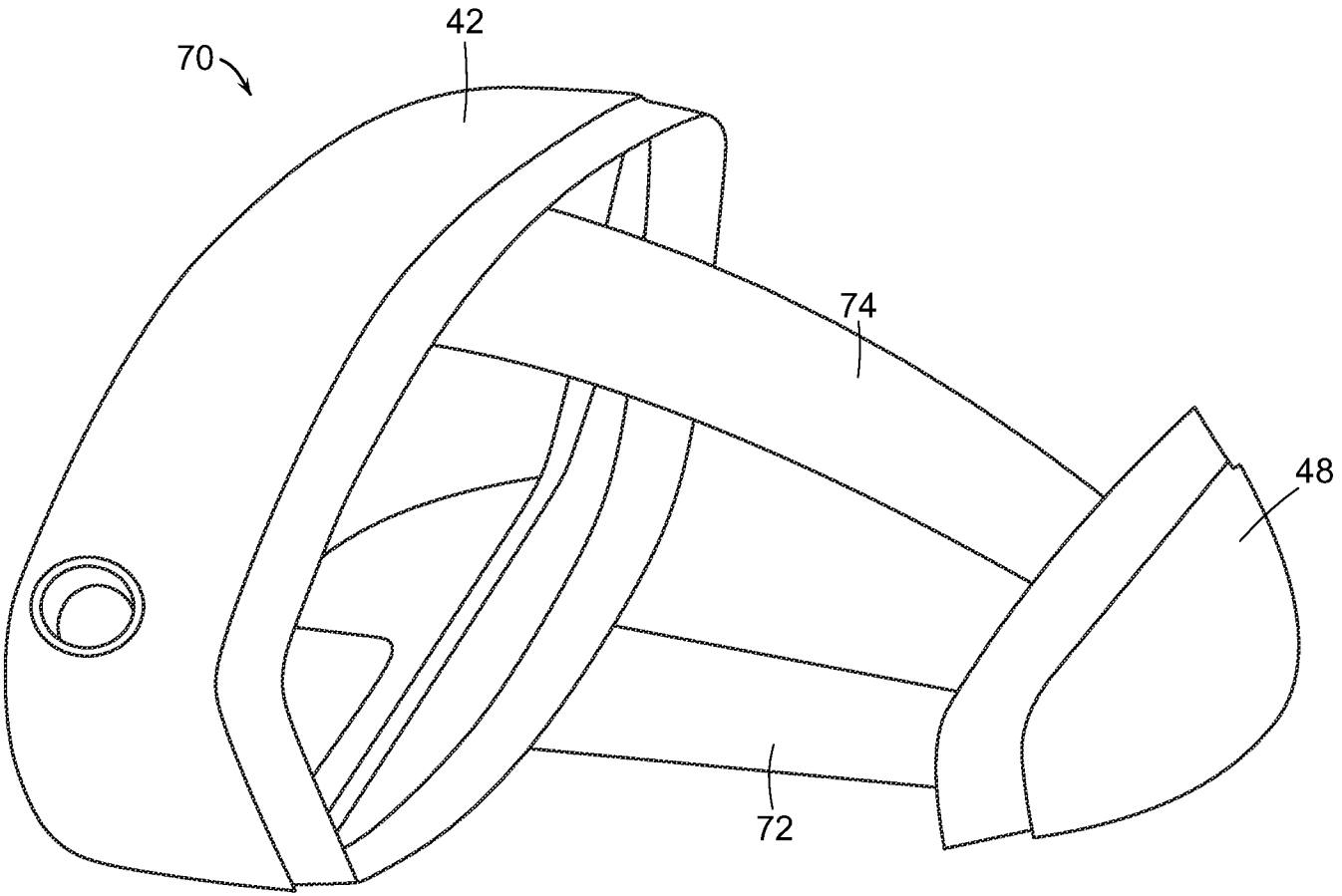

Club head 70, shown in FIG. 8, has sole bridge 72 and crown bridge 74 made from the same material as front hitting cup 42 and/or the aft cup 48 to increase structural support.

Figure 9:
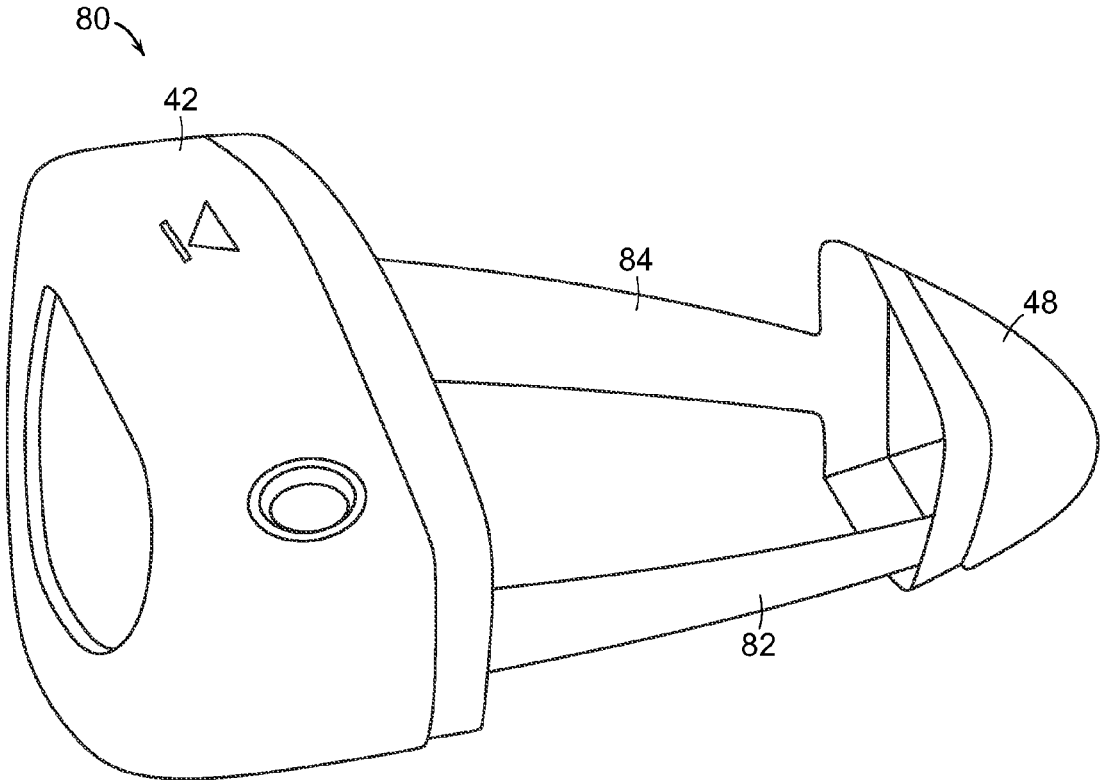

Club head 80, shown in FIG. 9, has heel bridge 82 and toe bridge 84.

Figure 10:
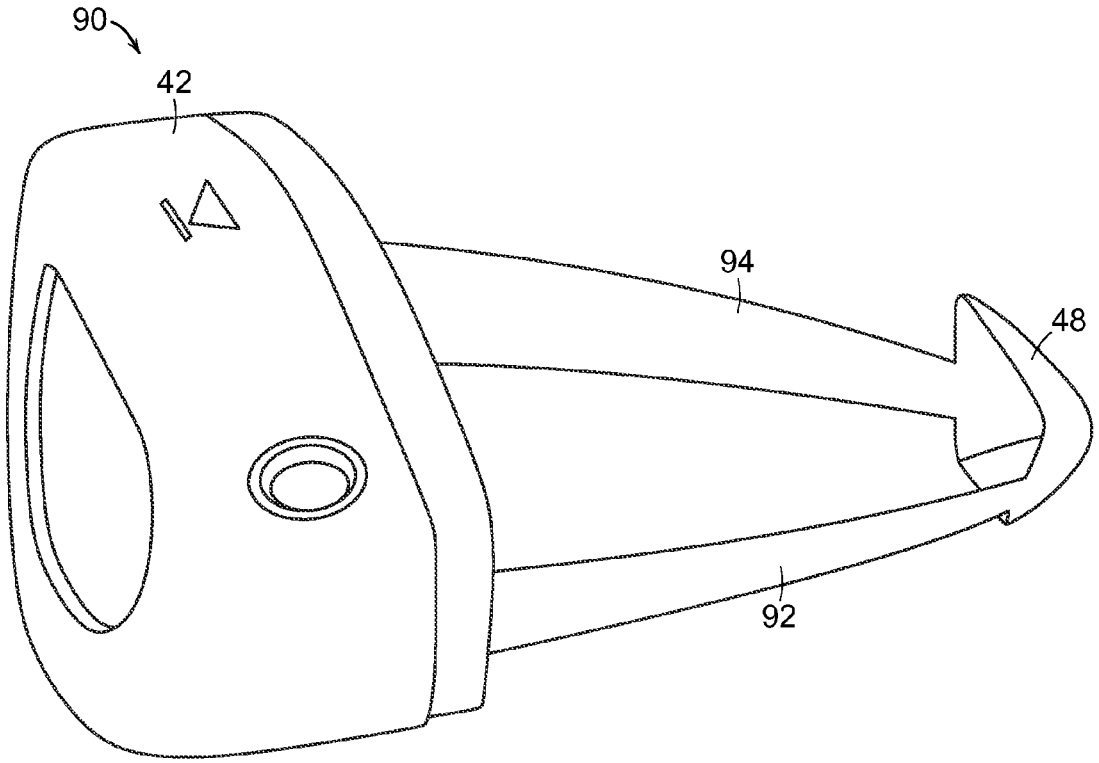

Club head 90, shown in FIG. 10, is similar to club head 80 and also has heel bridge 92 and toe bridge 94, except that aft cup 48 does not have a back ledge.

Figure 11:
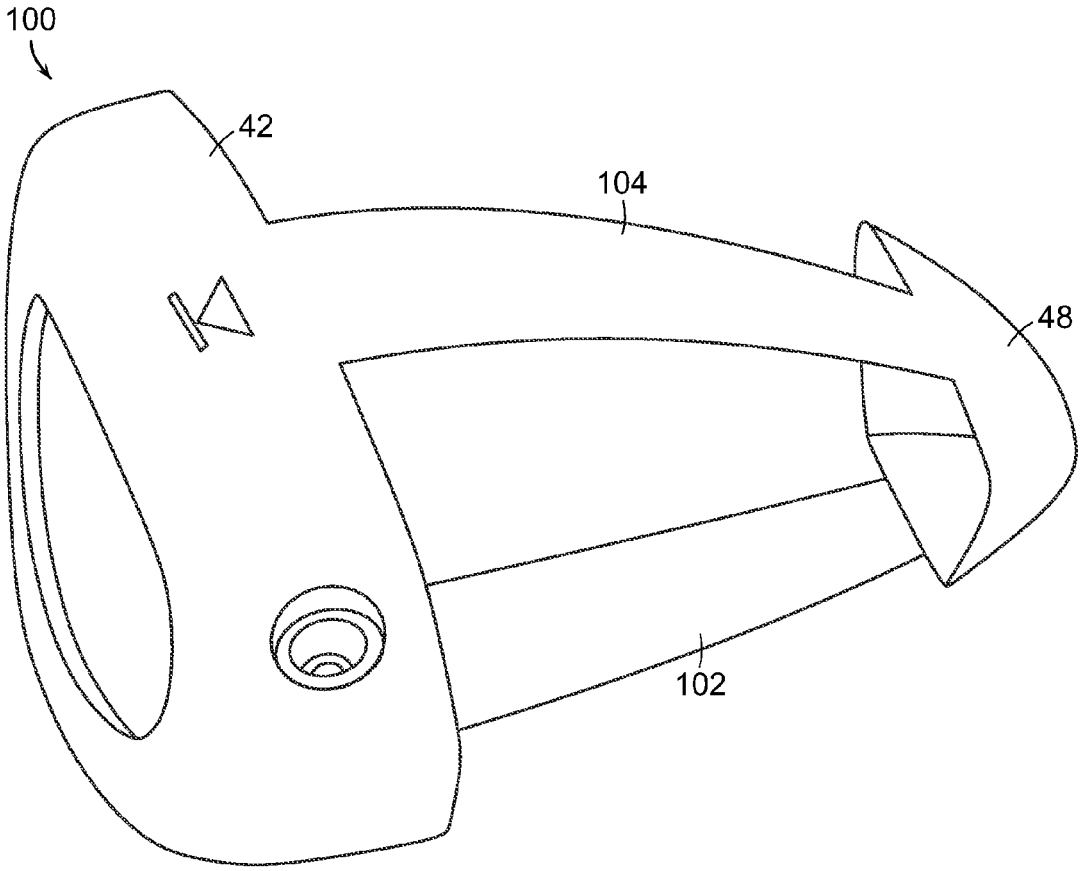

Club head 100, shown in FIG. 11, is similar to club head 70 and has sole bridge 102 and crown bridge 104, except that neither front hitting cup 42 nor aft cup 48 has a ledge.

Figure 12:
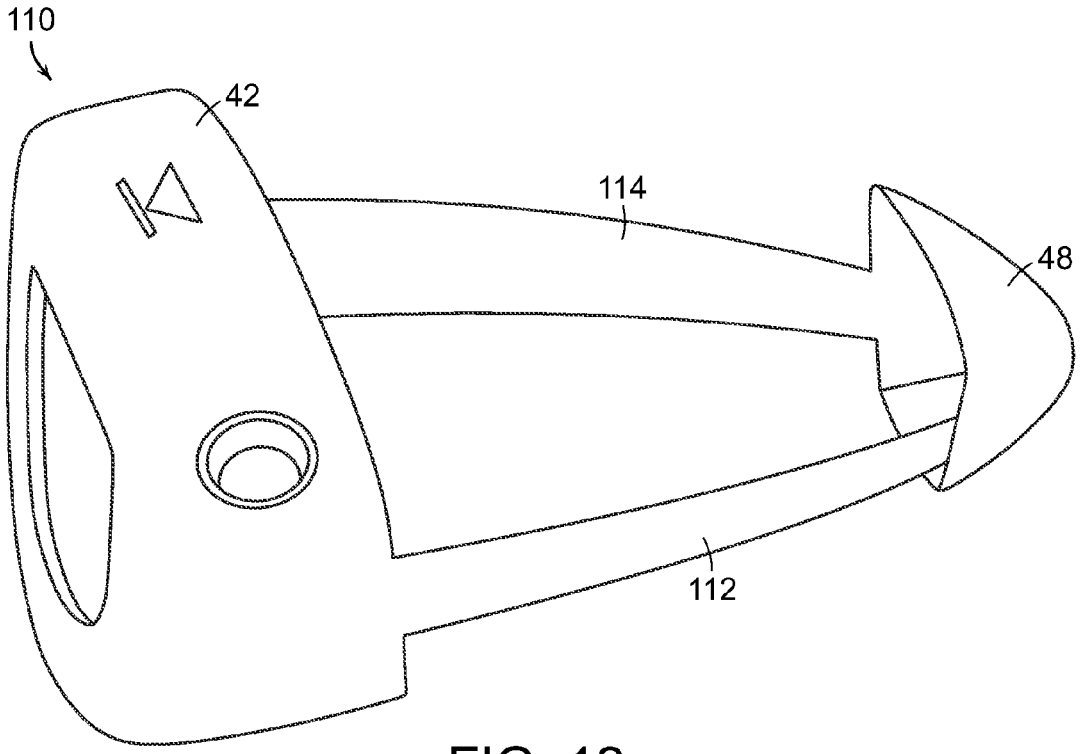

Club head 110, shown in FIG. 12, is similar to club heads 80 and 90 and has heel bridge 112 and toe bridge 114, except that neither front hitting cup 42 nor aft cup 48 has a ledge.

Figure 13:
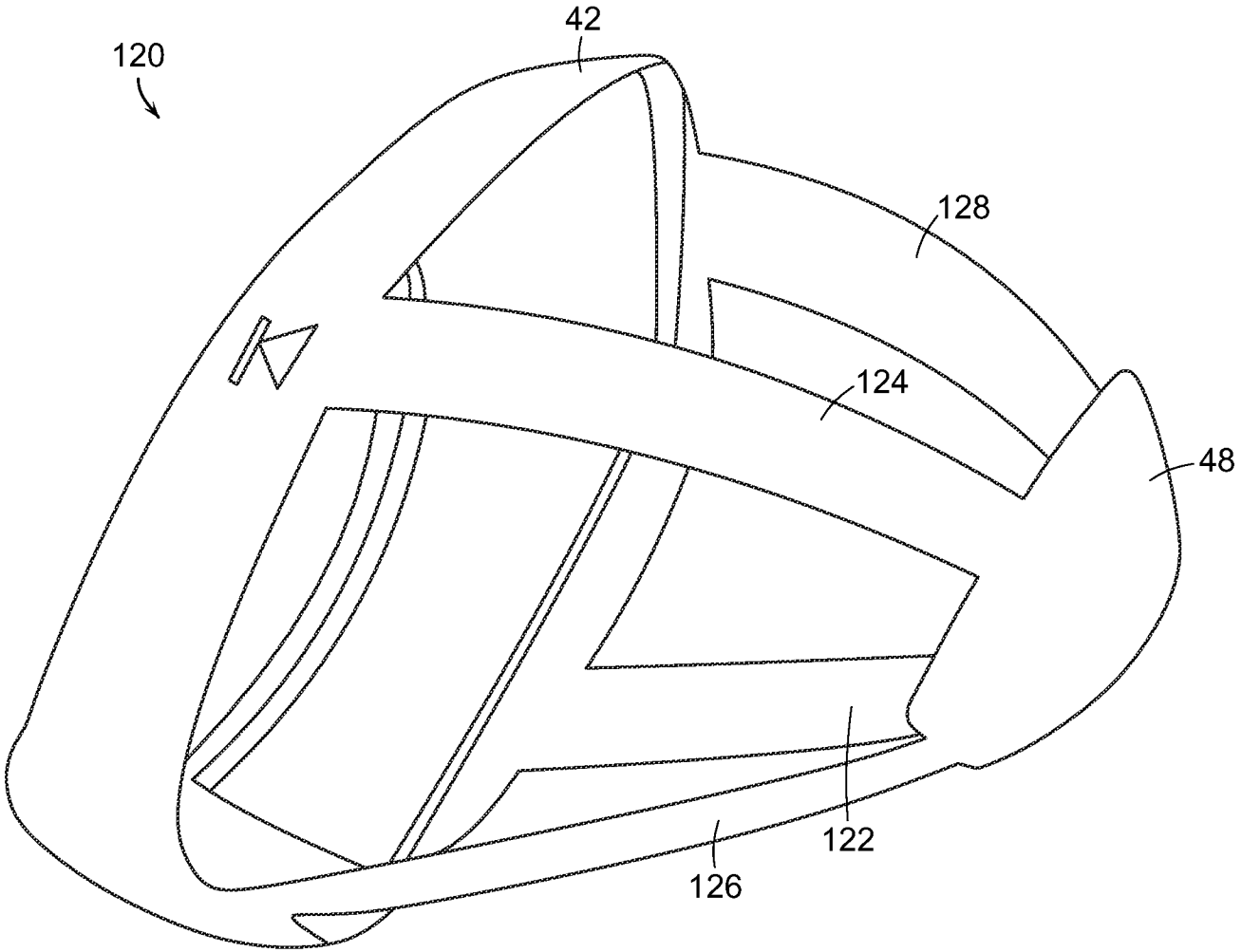

Additionally, club head 120, shown in FIG. 13, has front hitting cup 42 connected to aft cup 48 by sole bridge 122, crown bridge 124, heel bridge 126 and toe bridge 128. Front hitting cup 42 and aft cup 48 may or may not have ledges to help connect the cups to the lightweight midsection.

Figure 14:
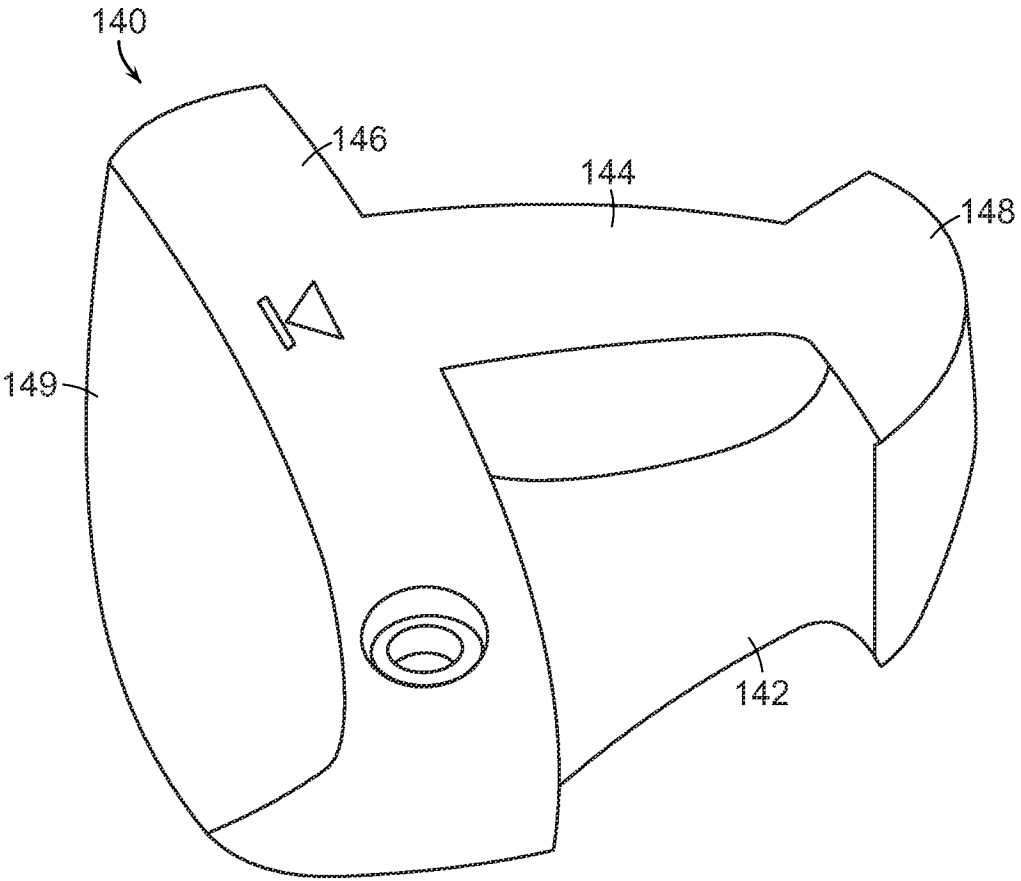
FIG. 14 is a perspective view of an alternative embodiment of inventive club heads with a lightweight midsection and a high moment of inertia.
Figure 16:
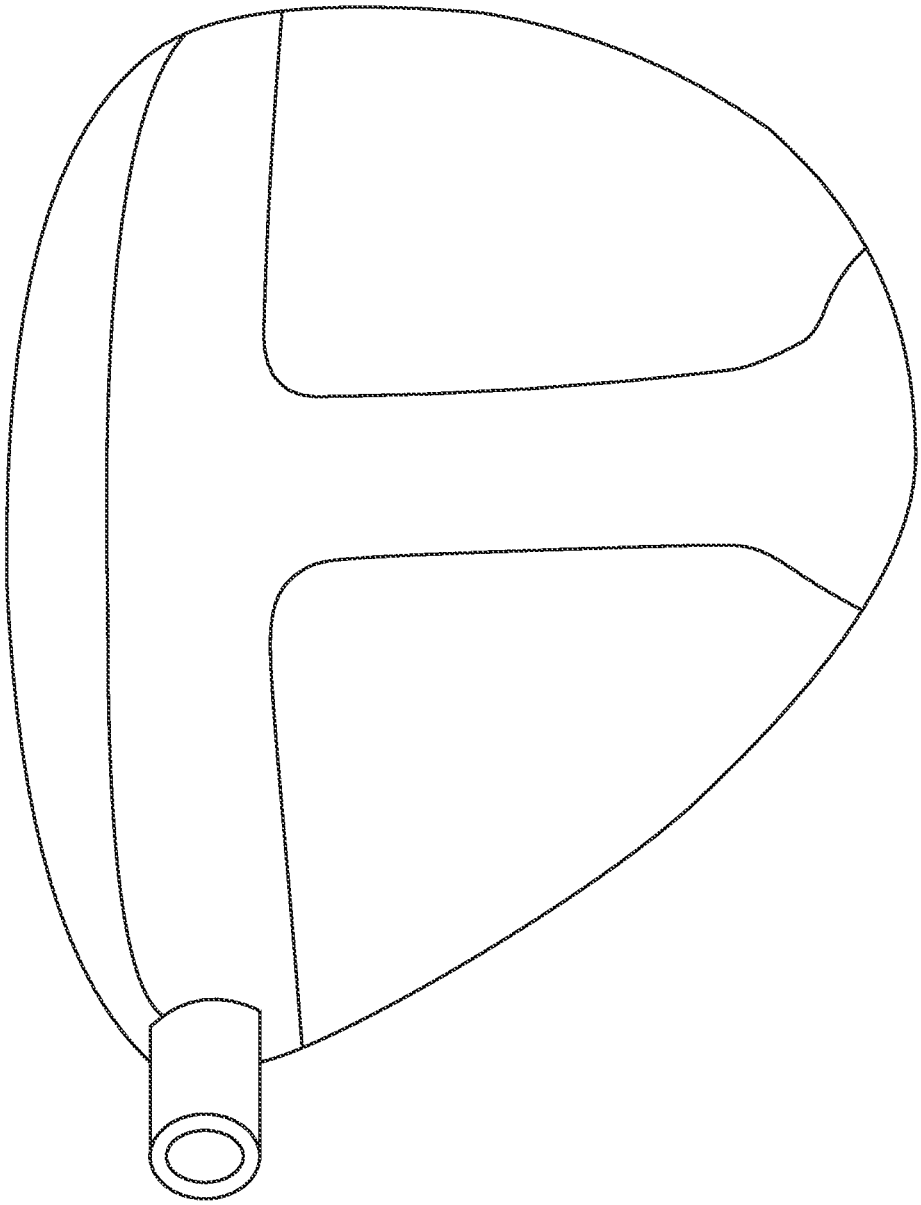
FIG. 16 is a top view of an alternative embodiment of the present invention as depicted in FIG. 14 with a lightweight midsection and a high moment of inertia.

FIG. 14 shows an alternative embodiment of the inventive golf club head 140 utilizing a more efficient shape for hollow club heads. Club head 140, shown in FIG. 14 as a traditional shaped club head, may contain a high Moment of Inertia (MOI) while maintaining a sole bridge 142 and crown bridge 144 similar to FIG. 11 shown above. As used herein, the term "traditional shaped" could be a pear shape club (as shown in FIG. 16), an elliptical shape club, a symmetrical shape club, or any other shape club wherein the heel wall and the toe wall are angled relative to one another, all without departing from the scope of the present invention. Club head 140, as shown in the alternative embodiment has a hitting cup 146 and an aft portion 148, wherein the aft portion 148 may have an aft wall length that is about 30% to about 50% of the horizontal length of hitting cup face 149; with 42% as the preferred ratio.

Figure 15:
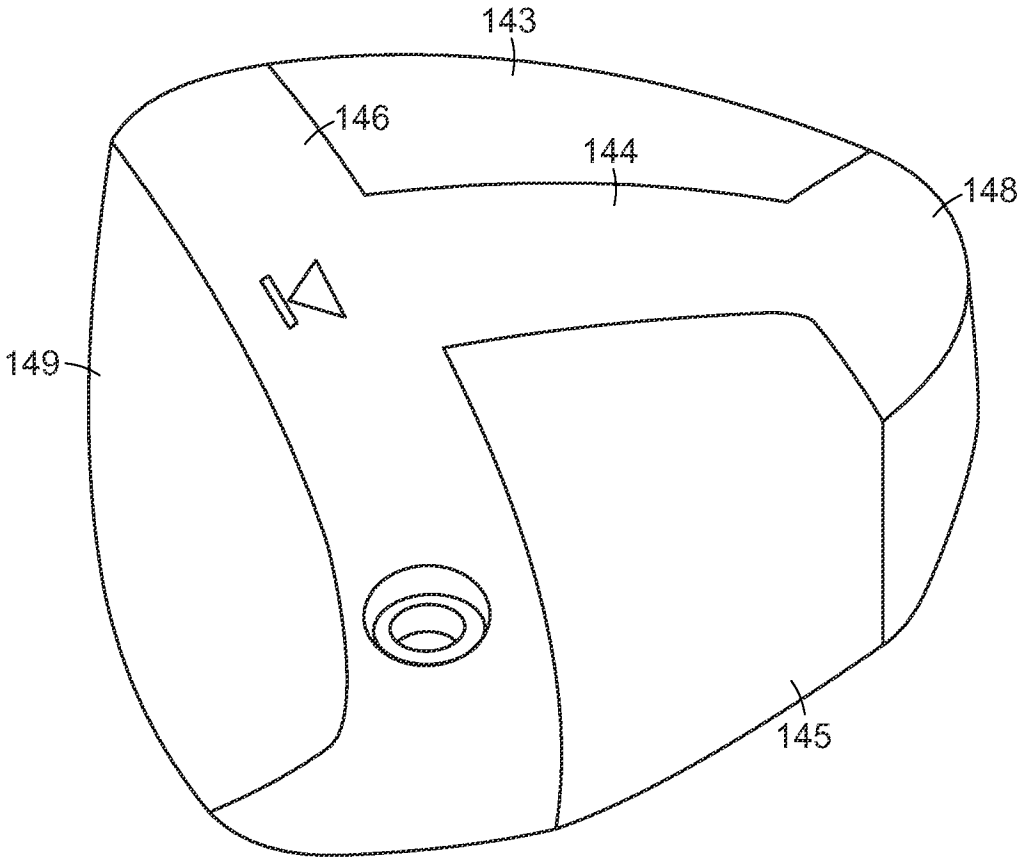
FIG. 15 is a perspective view of an alternative embodiment of the inventive club head with a lightweight midsection and a high moment of inertia with the enclosure sections assembled.

Golf club head 140 may utilize various enclosures to complete the midsection of golf club head 140. In this current exemplary embodiment shown in FIG. 15, enclosures 143 and 145 may be used to complete the midsection by filling in the areas that are not occupied by sole bridge 142 and crown bridge 144; however enclosures 143 and 145 may also overlap the sole bridge 142 and/or the crown bridge 144 to complete the midsection without departing from the scope of the present invention. Enclosures 143 and 145 in this current exemplary embodiment may resemble the shape of a clam shell, the shape of a C, the shape of an L, or any other shape capable of completing the midsection without departing from the scope of the present invention. Enclosures 143 and 145 may be made from a lightweight material, such as carbon fiber composites, aluminum, magnesium, titanium, thermoplastic or thermoset polymers, so that weight can be re-deployed from the midsection to the aft section and/or along the perimeter.

Golf club head 140, as shown in the current exemplary embodiment, may generally be made utilizing a bladder molding process; however other processes such as compression molding may also be used without departing from the scope and content of the present invention. The bladder molding process may generally involve positioning the enclosures 143 and 145 around the midsection of golf club head 140 around the sole bridge 142 and the crown bridge 144. Subsequent to positioning the enclosure 143 and enclosure 145 in place, an inflatable bladder or balloon (not shown) may be inserted into the cavity of golf club head 140 to create the inner wall profile for the enclosure 143 and enclosure 145. Bladder or balloon (not shown) may generally be an inflatable apparatus capable of expanding and compressing the enclosures 143 and 145 against an external mold of golf club head 140 without departing from the scope and content of the present invention. Once enclosures 143 and 145 are properly placed around the midsection and the bladder or balloon is inflated, an external mold may be used to form an external wall profile of golf club head 140 to allow pressure and heat to be exerted on the enclosures 143 and 145 to harden and cure the enclosures 143 and 145 if such process is needed in the instance of a pre-preg composite material.

The additional discretionary weight that is saved by the enclosures 143 and 145 may generally be relocated towards the rear of golf club head 140 to shift the center of gravity lower and deeper into golf club head 140; however, the discretionary weight could be shifted towards other areas of the golf club head 140 such as the front, the side, the top, the bottom, or in any direction within golf club head 140 without departing from the scope of the present invention. Discretionary weight that is moved to other areas of the golf club 140 may generally be achieved by using weight screws; however, additional methods for adding discretionary weight such as thickening the rear section of the sole, thickening the rear section of the crown, thickening the rear section of the skirt, or thickening any external wall section may all be used without departing from the scope of the present invention.

In this current alternative embodiment of the inventive golf club head, the volume of club head 140 may be approximately from 380 cc to 480 cc, more preferably from approximately 400 cc to 440 cc, and most preferably 420 cc. The weight of club head 140 may be about 180 grams to about 220 grams, preferably about 190 grams to about 210 grams, most preferably about 195 grams to about 205 grams. The height of the inventive golf club head 140 may generally be about 2.0 inches to about 3.0 inches, more preferably between 2.2 inches to 2.8 inches, most preferably about 2.4 inches or less. Finally, club head 140 may generally fit into a 5-inch square with about 5 mm of clearance. The shape of the club head 140 generally has approximately 60.25% of its volume behind the c.g., which is in conformity with the numbers associated with a traditional shaped driver. Finally, club head 140 may have a titanium hitting face with a thickness of approximately 0.130 inches, and the rest of club head 140 may be made from titanium with thickness of about 0.024 inches for the crown, about 0.024 inches for the skirt, and about 0.030 inches for the sole. In summary, the mass properties of the current alternative embodiment golf club head may be in accordance with very right column of Table 4 (see above)

volume of the club head could be greater than 0.90 kg·mm$^2$/cm$^3$, or more preferably greater than 1.00 kg·mm$^2$/cm$^3$.

Golf club head 140 of the present invention with the preferred volume of 380 cc to 480 cc generally has a moment of inertia about the y-axis, $I_{xx}$ to be from approximately 2000 g·cm$^2$ to approximately 4500 g·cm$^2$, more preferably from approximately 2500 g·cm$^2$ to approximately 4000 g·cm$^2$, even more preferably from 2575 g·cm$^2$ to approximately 3750 g·cm$^2$.

Figure 18:
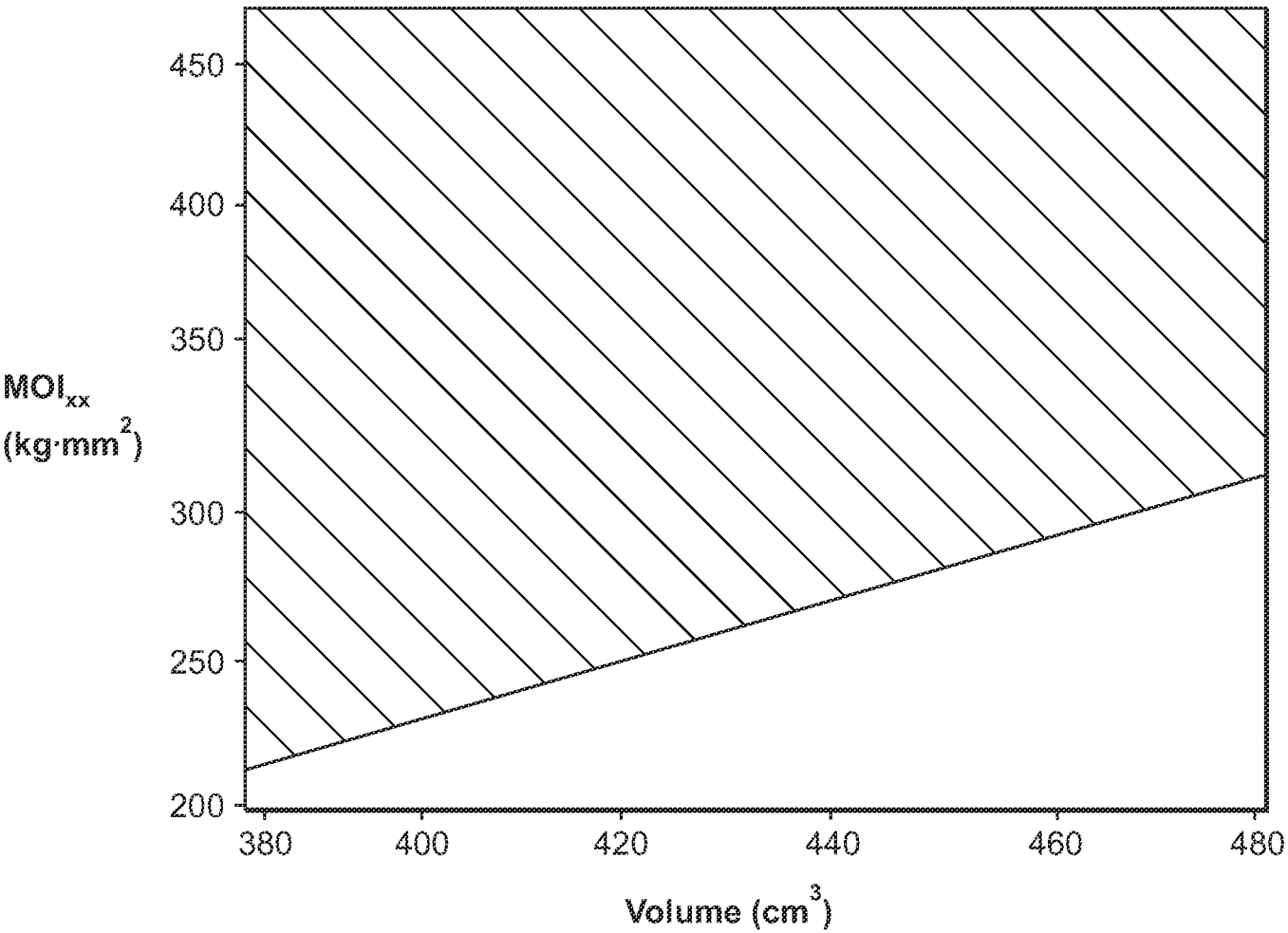
FIG. 18 is a graph showing the preferred range of moment of inertia about an x-axis $I_{xx}$ plotted against the volume of the golf club head of the present invention.

Golf club head 140 of the present invention with the preferred volume of 380 cc to 480 cc generally has a ratio of the $I_{xx}$ MOI (x-axis) to the volume of the club head preferably greater than about 0.50 kg·mm$^2$/cm$^3$ as shown in FIG. 18. More preferably, the ratio of the $I_{xx}$ MOI (x-axis) to the volume of the club head could be greater than 0.59 kg·mm$^2$/cm$^3$, or more preferably greater than 0.62 kg·mm$^2$/cm$^3$.

The mass properties of various composite club heads with a lightweight midsection and those of other club heads of various geometries were estimated using a CAD program to ascertain the optimal shape(s), c.g. locations and rotational inertias. The results are summarized in Table 5. For reference purpose, the mass properties of club heads 30 and 40 from Table 4 are repeated in Table 5 as Assemblies #3b and #3b-cf1, respectively. Moreover, club head 140 is also represented in Table 5 as Assembly #4 for purposes of comparing the results.

All the club heads in Table 5 weigh approximately 197 grams, and have a sole thickness of about 0.030 inch and crown/side wall thickness of about 0.024 inch, except that Assembly #3 has a crown/side wall thickness of 0.030 inch and Assemblies #3b-cf1, #3b-cf2, and Assembly #4 have Ti sidewalls of about 0.030 inch and carbon fiber midsection sidewalls of about 0.035 inch. Additionally, the "Maximum Dimensions" column indicates the dimensions of a rectangular prism that the club head would fit within. The maximum rectangular prism allowed by the USGA is 5"×5"×2.8".

TABLE 5

| Club Head | Vol. (cc) | Maximum Dimensions (inch) | Wt. avai. for MOI optimization (g) | C.G. from geometric center (inch) X | C.G. from geometric center (inch) Y | C.G.$_z$ from shaft axis | C.G.$_y$ from Grnd | $I_{xx}$ | $I_{yy}$ | $I_{xx}/I_{yy}$ |
|---|---|---|---|---|---|---|---|---|---|---|
| Ass'y #1-triangular club head 10 | 475 | 5 × 5 × 2.8 | 12.6 | 0.164 | −0.079 | −0.644 | 1.247 | 3410 | 4730 | 0.721 |
| Ass'y #2-triangular club head 10 | 415 | 5 × 5 × 1.9 | 30.2 | 0.164 | −0.050 | −1.005 | 1.047 | 3840 | 5210 | 0.737 |
| Ass'y #3-club head 30 | 464 | 5 × 5 × 1.94 | 16.6 | 0.149 | −0.033 | −0.801 | 1.076 | 3540 | 5190 | 0.682 |
| Ass'y #3b-club head 30 (all Ti) | 464 | 5 × 5 × 1.94 | 21.0 | 0.076 | −0.029 | −0.807 | 1.080 | 3500 | 5210 | 0.672 |
| Ass'y #3b-cf1-club head 40 with lightweight tube | 464 | 5 × 5 × 1.94 | 43.3 | 0.147 | −0.064 | −1.017 | 1.045 | 4400 | 5830 | 0.754 |
| Ass'y #3b-cf2-club head 40 with lightweight crown & sole | 464 | 5 × 5 × 1.94 | 24.5 | 0.067 | −0.044 | −0.845 | 1.065 | 3690 | 5550 | 0.665 |
| Ass'y #4-Club head 140 with lightweight enclosures | 449 | 5 × 5 × 1.94 | 38 | 0.020 | 0.024 | −0.721 | 1.122 | 2969 | 4748 | 0.625 |
| Titleist 905R | | | | 0.048 | 0.002 | −0.681 | 1.072 | 2660 | 4510 | 0.590 |

Golf club head 140 of the present invention with the preferred volume of 380 cc to 480 cc generally has a moment of inertia about the y-axis, $I_{yy}$ to be from approximately 4000 g·cm$^2$ to approximately 6000 g·cm$^2$, more preferably from approximately 4500 g·cm$^2$ to approximately 5500 g·cm$^2$, even more preferably from 4750 g·cm$^2$ to approximately 5250 g·cm$^2$.

Figure 17:
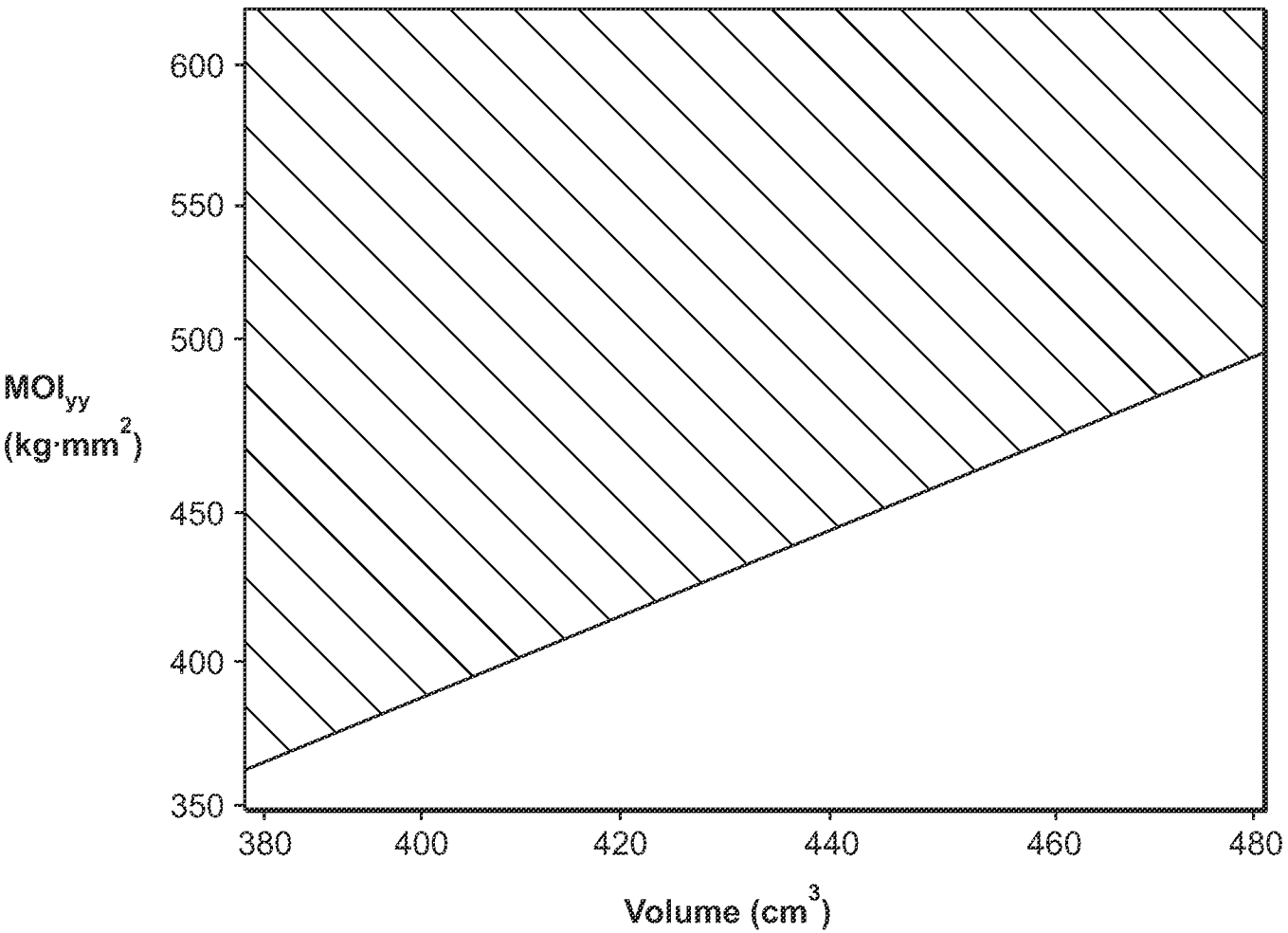
FIG. 17 is a graph showing the preferred range of moment of inertia about a y-axis $I_{yy}$ plotted against the volume of the golf club head of the present invention.

Golf club head 140 of the present invention with the preferred volume of 380 cc to 480 cc generally has a ratio of the $I_{yy}$ MOI (y-axis) to the volume of the club head preferably greater than about 0.80 kg·mm$^2$/cm$^3$ as shown in FIG. 17. More preferably, the ratio of the $I_{yy}$ MOI (y-axis) to the The results in Table 5 show that the club heads that contain a lightweight midsection, i.e., Assemblies #3b-cf1, #3b-cf2, and #4, have the highest combination of $I_{xx}$ and $I_{yy}$. Additionally, the results from Assemblies #1 and #2 show that for triangular club head, such as those shown in FIGS. **2*a*-2*d***, a smaller volume can produce higher $I_{xx}$ and $I_{yy}$ and lower c.g. from the ground, due to the efficiency of the triangular shape. Additionally, all the tested clubs show an $I_{xx}/I_{yy}$ ratio of higher than 0.650 and several have a ratio of 0.700 or higher. All the tested clubs have an $I_{xx}/I_{yy}$ ratio higher than the tested commercial club.

The club heads of the present invention can also be used with other types of hollow golf clubs, such as fairway woods, hybrid clubs or putters.

While various embodiments of the present invention have been described above, it should be understood that they have been presented by way of illustration and example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the appended claims and their equivalents. It will also be understood that each feature of each embodiment discussed herein, and of each reference cited herein, can be used in combination with the features of any other embodiment. All patents and publications discussed herein are incorporated by reference herein in their entirety.

What is claimed is:

1. A golf club head comprising:

a hitting cup comprised of a metallic material having a hitting surface;

an aft cup comprised of a metallic material;

a midsection connecting said hitting cup and said aft cup comprised of a composite material;

wherein said aft cup defines an aft wall length that is approximately 30% to about 50% of the length of said hitting surface, said aft wall length defined as the longest distance of said aft cup measured in a heel to toe direction viewed from a top view of said club head.

2. The golf club head of claim 1, wherein said golf club head has a volume of about 380 cc to 480 cc, a moment of inertia, $I_{xx}$, about a horizontal axis through a center of gravity of said golf club head of about 200 g·cm$^2$ to about 4500 g·cm$^2$, and a moment of inertia, $I_{yy}$, about a vertical axis through said center of gravity of said golf club head of about 400 g·cm$^2$ to about 5900 g·cm$^2$.

3. The golf club head of claim 2, wherein a ratio of said moment of inertia $I_{yy}$ to said volume is greater than about 1.00 kg·mm$^2$/cm$^3$.

4. The golf club head of claim 3, wherein a ratio of said density of moment of inertia $I_{xx}$ to said volume is greater than about 0.62 kg·mm$^2$/cm$^3$.

5. The golf club head of claim 1, wherein a density of said midsection is less than a density of said hitting cup or a density of said aft cup.

6. The golf club of claim 5, wherein said density of said midsection is less than about half of said density of said hitting cup or said density of said aft cup.

7. The golf club of claim 6, wherein said density of said midsection is less than about one third of said density of said hitting cup or said density of said aft cup.

8. The golf club of claim 5, wherein said density of said midsection is about 1.2 g/cc.

9. The golf club head of claim 1, wherein said midsection further comprises at least one bridge section extending a long a sole portion of said golf club head from said hitting cup towards said aft cup.

10. The golf club head of claim 1, further comprising a heel wall and a toe wall, both of which combine to connect said hitting cup to said aft cup.

11. The golf club head of claim 10, wherein said heel wall and said toe wall are angled relative to one another.

12. The golf club head of claim 1, wherein said hitting cup is made from titanium.

13. A golf club head comprising:

a hitting surface;

an aft wall; and a midsection, further comprising a heel wall and a toe wall, connecting said hitting surface and said aft wall, wherein said aft wall is spaced apart from said hitting surface and wherein said aft wall length is approximately 30% to about 50% of the length of said hitting surface, wherein the length is measured in a toe and heel direction, said aft wall length defined as the longest distance of said aft cup measured in a heel to toe direction viewed from a top view of said club head.

14. The golf club head of claim 13, wherein said heel wall and said toe wall are angled relative to each other.

15. The golf club head of claim 14, wherein said golf club head is substantially triangular shape.

16. The golf club head of claim 14, wherein said golf club head is substantially pear shaped.

17. The golf club of claim 14, wherein said golf club head has a volume of about 380 cc to 480 cc, a moment of inertia, $I_{xx}$, about a horizontal axis through a center of gravity of said golf club head of about 200 g·cm$^2$ to about 4500 g·cm$^2$, and a moment of inertia, $I_{yy}$, about a vertical axis through said center of gravity of said golf club head of about 400 g·cm$^2$ to about 5900 g·cm$^2$.

18. The golf club of claim 17, wherein said golf club has a volume of about 440 cc to about 460 cc.

* * * * *